US008540326B2

(12) United States Patent
Moszer

(10) Patent No.: US 8,540,326 B2
(45) Date of Patent: Sep. 24, 2013

(54) STACKABLE FOOTWEAR STORAGE CABINET

(76) Inventor: Joan M. Moszer, Cottage Grove, MN (US)

( * ) Notice: Subject to any disclaimer, the term of this patent is extended or adjusted under 35 U.S.C. 154(b) by 9 days.

(21) Appl. No.: 13/162,113

(22) Filed: Jun. 16, 2011

(65) Prior Publication Data

US 2012/0319547 A1 Dec. 20, 2012

(51) Int. Cl.
*F16B 12/00* (2006.01)

(52) U.S. Cl.
USPC ..... 312/111; 312/198; 248/501

(58) Field of Classification Search
USPC ..... 312/107, 111, 117, 122, 198, 108; 206/512, 509, 511; 248/188.2, 188.4, 601, 248/600, 500; 403/353, 331, 360, 381
See application file for complete search history.

(56) References Cited

U.S. PATENT DOCUMENTS

| | | | | |
|---|---|---|---|---|
| 2,386,343 | A * | 10/1945 | Regenhardt | 312/111 |
| 3,529,878 | A * | 9/1970 | Blowers | 312/107 |
| 3,563,390 | A | 2/1971 | Kim | |
| 3,746,391 | A | 7/1973 | Novak | |
| 4,168,871 | A | 9/1979 | Dierkes | |
| 5,096,056 | A * | 3/1992 | Garcia | 206/749 |
| 5,104,208 | A | 4/1992 | Gesing | |
| 5,984,113 | A | 11/1999 | Roberson | |
| 6,029,940 | A * | 2/2000 | Klein | 248/346.04 |
| 6,047,940 | A * | 4/2000 | Kaplan | 248/501 |
| 6,196,758 | B1 * | 3/2001 | Scarborough | 403/353 |
| 6,273,259 | B1 * | 8/2001 | Stahl | 206/511 |
| 6,427,966 | B1 * | 8/2002 | Blumenschein | 248/678 |
| 6,598,948 | B1 | 7/2003 | Harmon | |
| 6,732,858 | B1 | 5/2004 | Chang Ou | |
| D527,901 | S | 9/2006 | Selsted | |
| 7,413,371 | B2 * | 8/2008 | Arnold et al. | 403/353 |
| D580,172 | S | 11/2008 | Perez | |
| D590,153 | S | 4/2009 | Sapp | |
| D611,162 | S | 3/2010 | Moon | |
| 7,685,846 | B2 * | 3/2010 | Hwang et al. | 68/3 R |
| 7,690,856 | B2 * | 4/2010 | Mortensen | 403/326 |
| 8,079,555 | B2 * | 12/2011 | Erdmann et al. | 248/188.4 |
| 2004/0188285 | A1 * | 9/2004 | Yoshikawa | 206/278 |
| 2005/0139738 | A1 * | 6/2005 | Hwang et al. | 248/188.1 |
| 2005/0172678 | A1 * | 8/2005 | Kim et al. | 68/3 R |
| 2005/0224384 | A1 * | 10/2005 | Sands et al. | 206/503 |
| 2005/0280337 | A1 * | 12/2005 | Jackson et al. | 312/198 |
| 2006/0119060 | A1 * | 6/2006 | Sullivan et al. | 280/79.11 |
| 2006/0231602 | A1 | 10/2006 | Mu et al. | |
| 2007/0039840 | A1 | 2/2007 | Mu et al. | |
| 2007/0052330 | A1 * | 3/2007 | Chang | 312/111 |
| 2007/0119216 | A1 * | 5/2007 | Jeong et al. | 68/3 R |
| 2008/0053116 | A1 * | 3/2008 | Reyzin et al. | 62/121 |
| 2009/0039747 | A1 * | 2/2009 | Webster et al. | 312/334.1 |
| 2011/0198458 | A1 * | 8/2011 | Karl et al. | 248/188.4 |
| 2011/0241501 | A1 * | 10/2011 | Heo | 312/107 |

FOREIGN PATENT DOCUMENTS

| | | |
|---|---|---|
| WO | WO2006/113508 | 4/2006 |

* cited by examiner

*Primary Examiner* — Darnell Jayne
*Assistant Examiner* — Daniel Rohrhoff
(74) *Attorney, Agent, or Firm* — Antonio Papageorgiou; Ostrow Kaufman LLP

(57) ABSTRACT

A stackable footwear storage cabinet is provided that includes a plurality of components forming a cubic arrangement inclosing an interior space for a drawer with dividers to store footwear in a vertical fashion. Two or more units capable of being interlocked in a vertical stack, counter weighted to prevent tipping over when the fully loaded drawers are extended open.

7 Claims, 12 Drawing Sheets

STACKABLE FOOTWEAR STORAGE CABINET

BACKGROUND

The present application relates to footwear storage, in particular to storing footwear in an open room.

Shoes, sandals, boots and other forms of footwear are primarily stored in closets. In more resent years the size of homes has been on the increase. With larger room sizes more furniture can be used in a room. Larger sized furniture is also being manufactured in the interest of filling a rooms volume. Along with this trend has come the popularity of using room space for in room storage. Cabinets to store house wares or clothing are two examples of this type of storage.

There is a problem with using cabinets designed for storage of house wares and clothing, to store footwear. Often times the ratio of cabinet size is not in agreement with the size of footwear. Footwear, in a conglomerate, can become very heavy and tip a conventional cabinet over, causing harm and injury. Footwear can quickly fill one cabinet requiring the addition of other cabinets. Often times leading to an unorganized situation.

Various attempts have been made to create cabinets to store shoes and other footwear. Most of these attempts have been in regard to cabinets intended for use in a closet and are unsightly for in room use. Other in room cabinets have open fronts, revealing the inside of the cabinet, leaving the footwear in view. Another ineffective solution has been the use of horizontally pivoted front door panels on cabinets. This system requires footwear to be set side by side and is not an efficient use of cabinet space.

Accordingly there is a need for a stackable footwear storage cabinet which over comes the limitations of storing footwear horizontally, maximizes the use of cabinet space, conceals the footwear from view and allows for accumulating footwear in a single location, in an organized, stable and accessible way.

SUMMARY

In at least one embodiment, a storage cabinet is provided comprising: left side, right side, and rear panels arranged to provide a structure with an interior space and an opening in a front of the structure for access to the interior space; and at least one drawer coupled to the structure with at least one slide, the at least one drawer therewith slidable between a closed position and an open position exposing contents of the drawer, the at least one drawer comprising dividers essentially orthogonal to a base of the drawer arranged to form a plurality of vertical compartments.

In at least one embodiment, the panels are arranged to form a cubic structure.

In at least one embodiment, the storage cabinet comprises a removable top, the structure having a plurality of slots revealed by removing the top, each of the plurality of slots located to accommodate and connect to a corresponding foot of another storage cabinet, the storage cabinet therewith stackable with the another storage cabinet.

In at least one embodiment, the plurality of slots are arranged to allow the corresponding feet of the another storage cabinet to slide into the slots horizontally from back to front of the storage cabinet while preventing the feet of another storage cabinet from moving vertically and to lock the another storage cabinet to the storage cabinet when the another storage cabinet is slid to the front of the storage cabinet.

In at least one embodiment, the storage cabinet comprises at least one counterweight located in the cabinet to prevent tipping of the storage cabinet when the at least one drawer is extended to the open position.

In at least one embodiment, a storage cabinet is provided comprising: left side, right side, and rear panels arranged to provide a cubic structure with an interior space and an opening in a front of the structure for access to the interior space; a removable top; and at least one drawer coupled to the structure with at least one slide, the at least one drawer therewith slidable between a closed position and an open position exposing contents of the drawer, the at least one drawer comprising dividers essentially orthogonal to a base of the drawer arranged to form a plurality of vertical compartments, the structure having a plurality of slots revealed by removing the top, each of the plurality of slots located to accommodate and lock to a corresponding foot of another storage cabinet, the storage cabinet therewith stackable with the another storage cabinet.

In at least one embodiment, the storage cabinet comprises at least one counterweight located in the cabinet to prevent tipping of the storage cabinet when the at least one draw is extended to the open position.

In at least one embodiment, method for storing shoes is provided comprising placing a drawer of a storage cabinet in an open position, the storage cabinet comprising left side, right side, and rear panels arranged to provide a structure with an interior space and an opening in a front of the structure for access to the interior space, the at least one drawer coupled to the structure with at least one slide, the at least one drawer therewith slidable between a closed position and the open position exposing contents of the drawer, the at least one drawer comprising dividers essentially orthogonal to a base of the drawer arranged to form a plurality of vertical compartments; and placing at least one pair of shoes in a divider vertically.

In at least one embodiment, the panels are arranged to form a cubic structure.

In at least one embodiment, the storage cabinet comprises a removable top, the structure having a plurality of slots revealed by removing the top, each of the plurality of slots located to accommodate and connect to a corresponding foot of another storage cabinet, the storage cabinet therewith stackable with the another storage cabinet.

In at least one embodiment, the plurality of slots are arranged to allow the corresponding feet of the another storage cabinet to slide into the slots horizontally from back to front of the storage cabinet while preventing the feet of another storage cabinet from moving vertically and to lock the another storage cabinet to the storage cabinet when the another storage cabinet is slid to the front of the storage cabinet.

In at least one embodiment, the cabinet comprises at least one counterweight located in the cabinet to prevent tipping of the storage cabinet when the at least one drawer is extended to the open position.

Additional aspects of the present invention will be apparent in view of the description which follows.

DETAILED DESCRIPTION OF THE INVENTION

Figure 1:
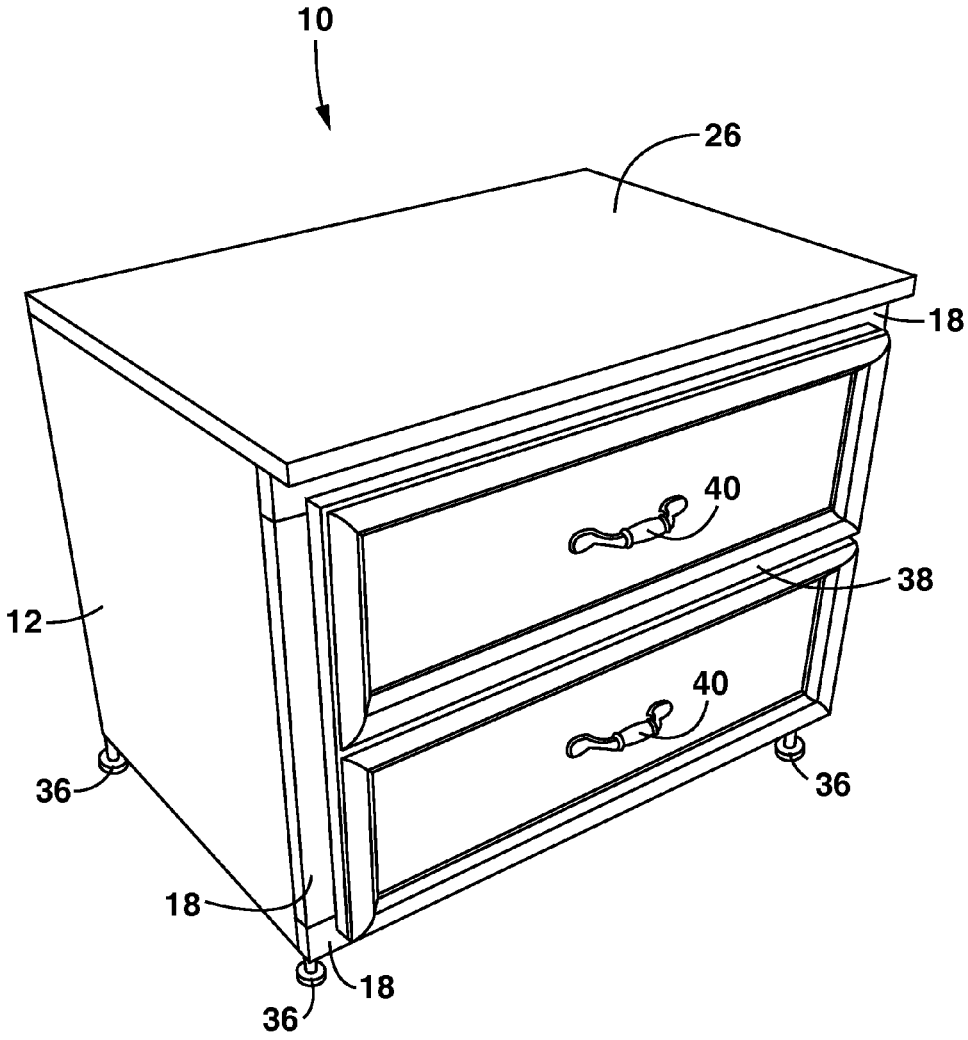
FIG. 1 is a perspective view of the stackable footwear storage cabinet.

While the specification concludes with claims defining the features of the invention that are regarded as novel, it is believed that the storage cabinet according to this application will be better understood from a consideration of the description in conjunction with the drawings. As required, detailed embodiments of the present cabinet are disclosed herein; however, it is to be understood that the disclosed embodiments are merely exemplary of the embodiments, which can be embodied in various forms. Therefore, specific structural and functional details disclosed herein are not to be interpreted as limiting, but merely as a basis for the claims and as a representative basis for teaching one skilled in the art to variously employ the cabinets disclosed herein in virtually any appropriately detailed structure. Further, the terms and phrases used herein are not intended to be limiting but rather to provide an understandable description of the embodiments disclosed herein.

FIG. 1 through FIG. 6 illustrate one embodiment of the stackable footwear storage cabinet 10 that is useful for understanding the inventive concepts disclosed herein. As shown, stackable footwear storage cabinet 10 can include the left side panel 12, right side panel 14, dimensional lumber 16, front stiles 18 and back panel 20. All of the previous mentioned components are configured in a cubic arrangement to form the interior space 22 with the front opening 24 for receiving the drawer 38 and the feet 36 for supporting a cabinet 10.

The top panel 26 can be removed to reveal the concealed interior panel 28, connecting plates 46, latch 32 and drawer slides 30.

A drawer 38 can have one or more handles 40 attached to or an integral part thereof. One or more drawer slides 30 are attached to the left and right hand sides of drawer 38, in the preferred embodiment, and connect drawer 38 with cabinet 10. Drawer 38 can contain permanent or removable dividers 42. The dividers 42 form one or more compartments to store footwear 44 in a vertical fashion.

In the preferred embodiment the construction of the left side panel 12 and the right side panel 14 is of 0.25 inch thick overlaid plywood. The top panel 26 is constructed from 0.75 inch thick overlaid plywood with finished edges. The stiles 18 are constructed from 0.75 inch thick lumber. The dimensional lumber 16 is cut to size and has a width and height of 1.25 to 1.50 inches respective of its position in the cabinet 10. The back panel 20 and interior panel 28 are constructed from 0.50 inch thick composition board. The drawer 38 and dividers 42 are constructed from a variety of wood materials well known in the arts.

In the preferred embodiment the width $\alpha$ of cabinet 10 is 24.75 inches. The height $\beta$ is 18.25 inches. The depth $\chi$ is 16.25 inches. The centers of feet 36 are set at a critical width $\delta$ of 23.125 inches and depth $\epsilon$ of 14.25 inches.

Figure 2:
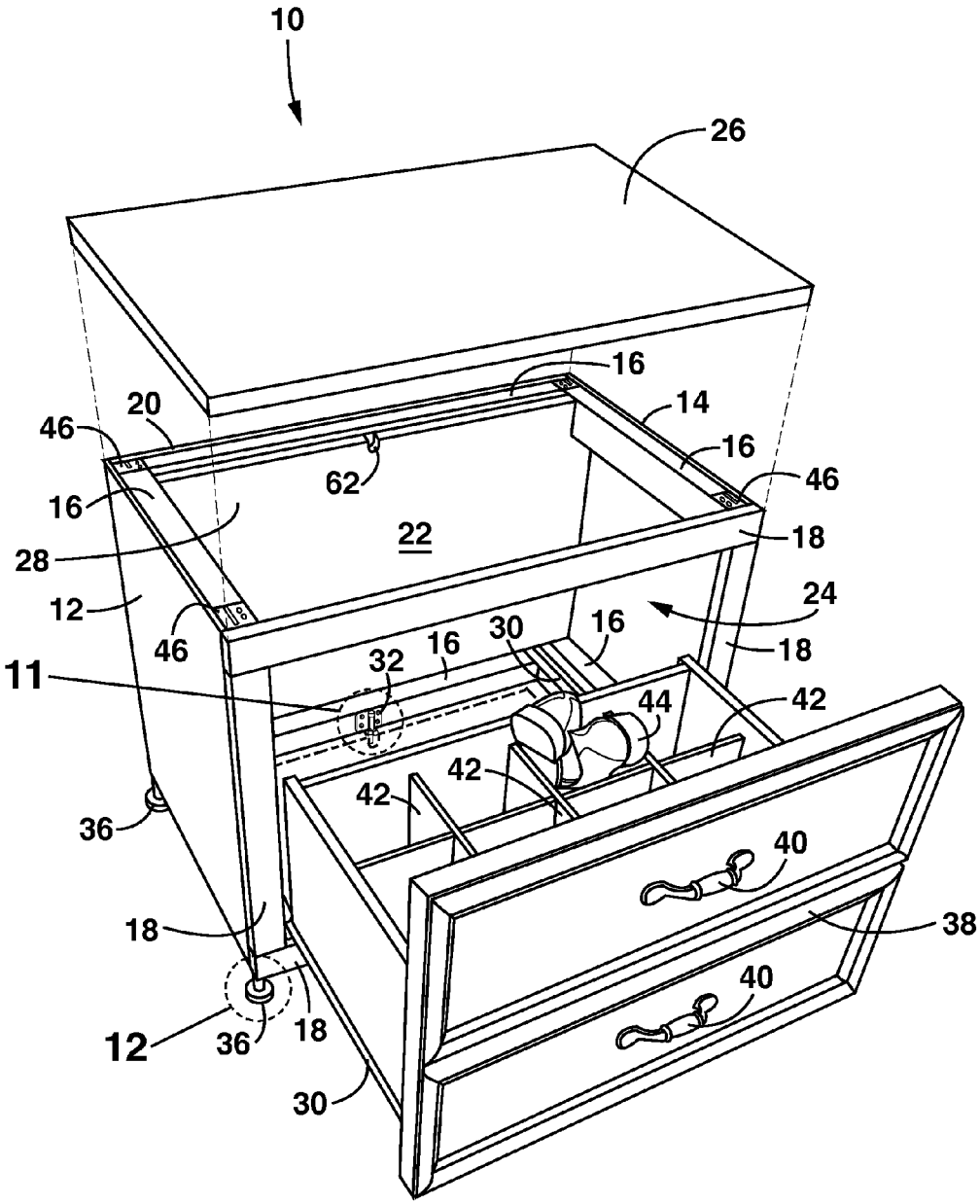
FIG. 2 is an exploded view of FIG. 1.
Figure 3:
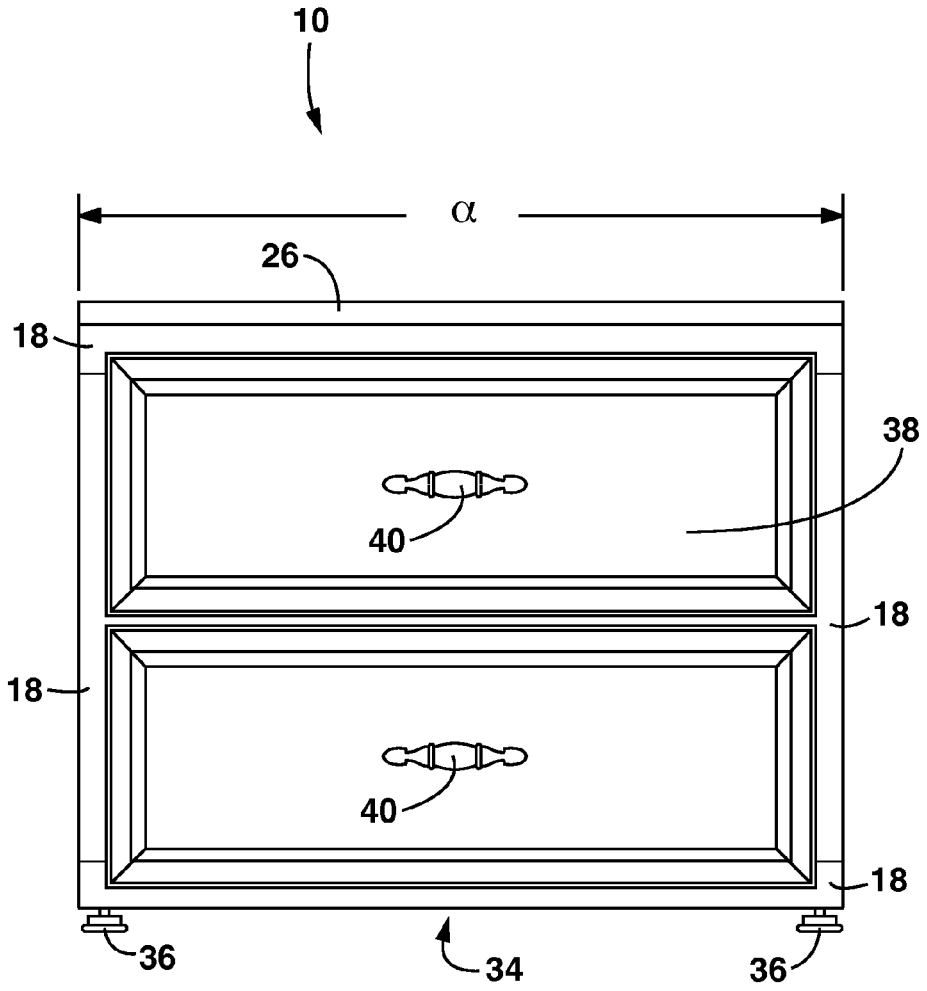
FIG. 3 is a front view of FIG. 1.
Figure 4:
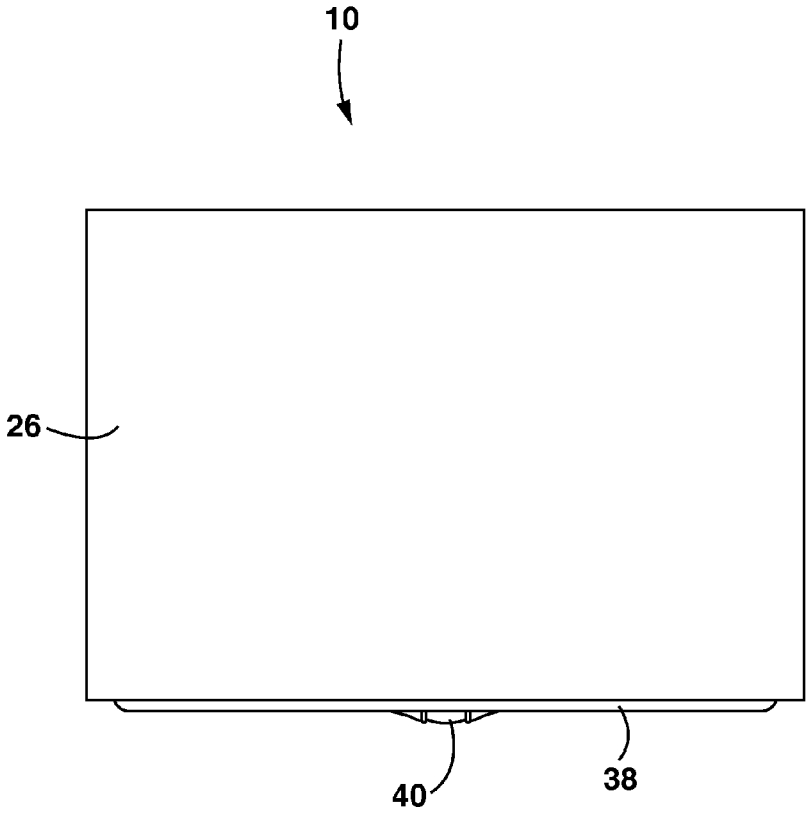
FIG. 4 is a top view of FIG. 1.
Figure 5:
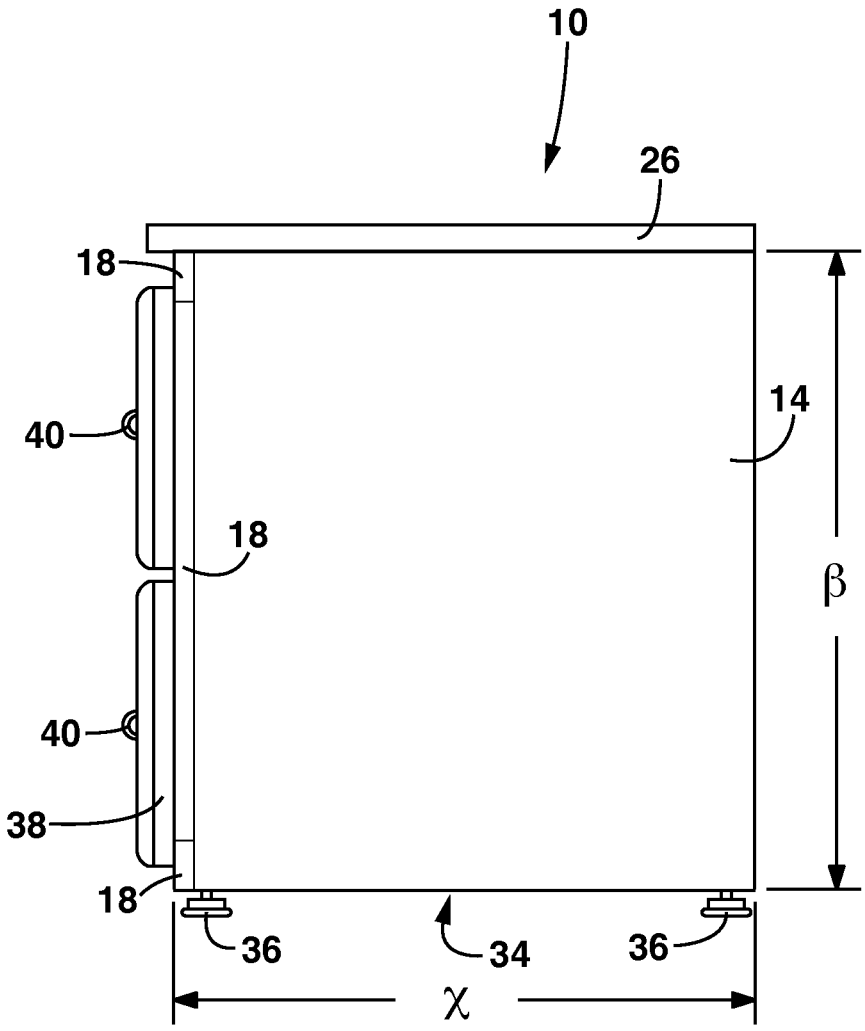
FIG. 5 is a right side view of FIG. 1 the left side view being opposite.
Figure 6:
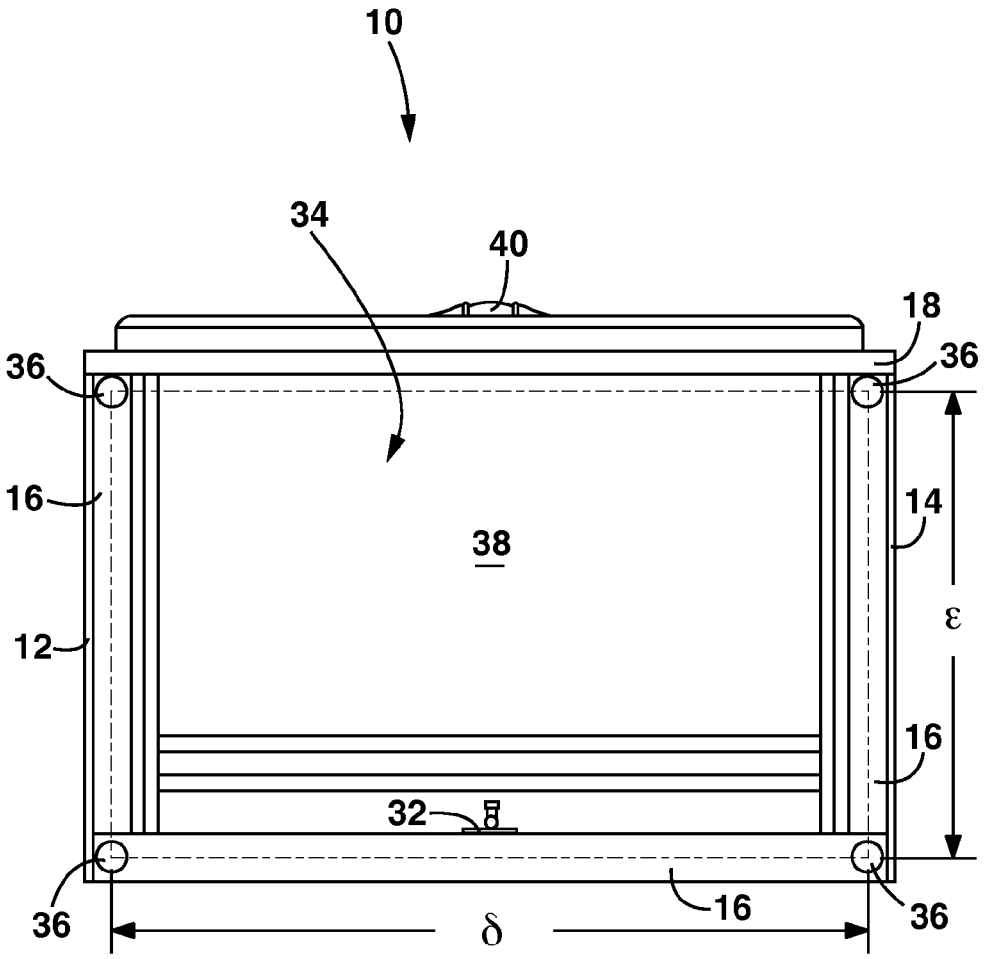
FIG. 6 is a bottom view of FIG. 1.
Figure 7:
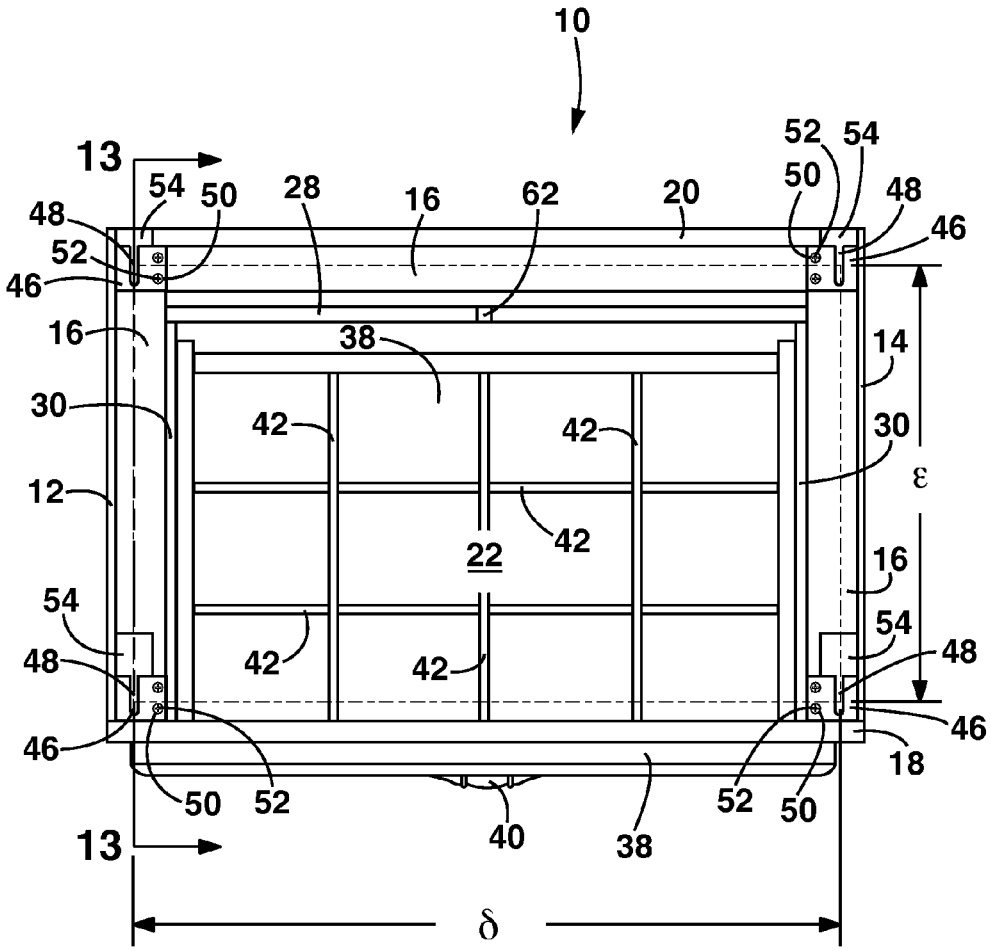
FIG. 7 is a top view of FIG. 2 with the top panel removed.

FIG. 7 illustrates a top view of FIG. 2 with the top panel 26 removed. The connecting plates 46, in the preferred embodiment, are constructed of 0.06 inch thick steel. A slot 48 accommodates the width of adjustable means 64 attached to foot 36 and is cut into plate 46 along with one or more holes 50. Fasteners 52 are inserted through holes 50 to secure plates 46 to dimensional lumber 16. It is critical, plates 46 are set in position to accommodate the critical width $\delta$ of 23.125 inches and depth $\epsilon$ of 14.25 inches of the centers of feet 36. Plates 46 are set above cavities 54 which are formed by routering them into dimensional lumber 16.

Figure 8:
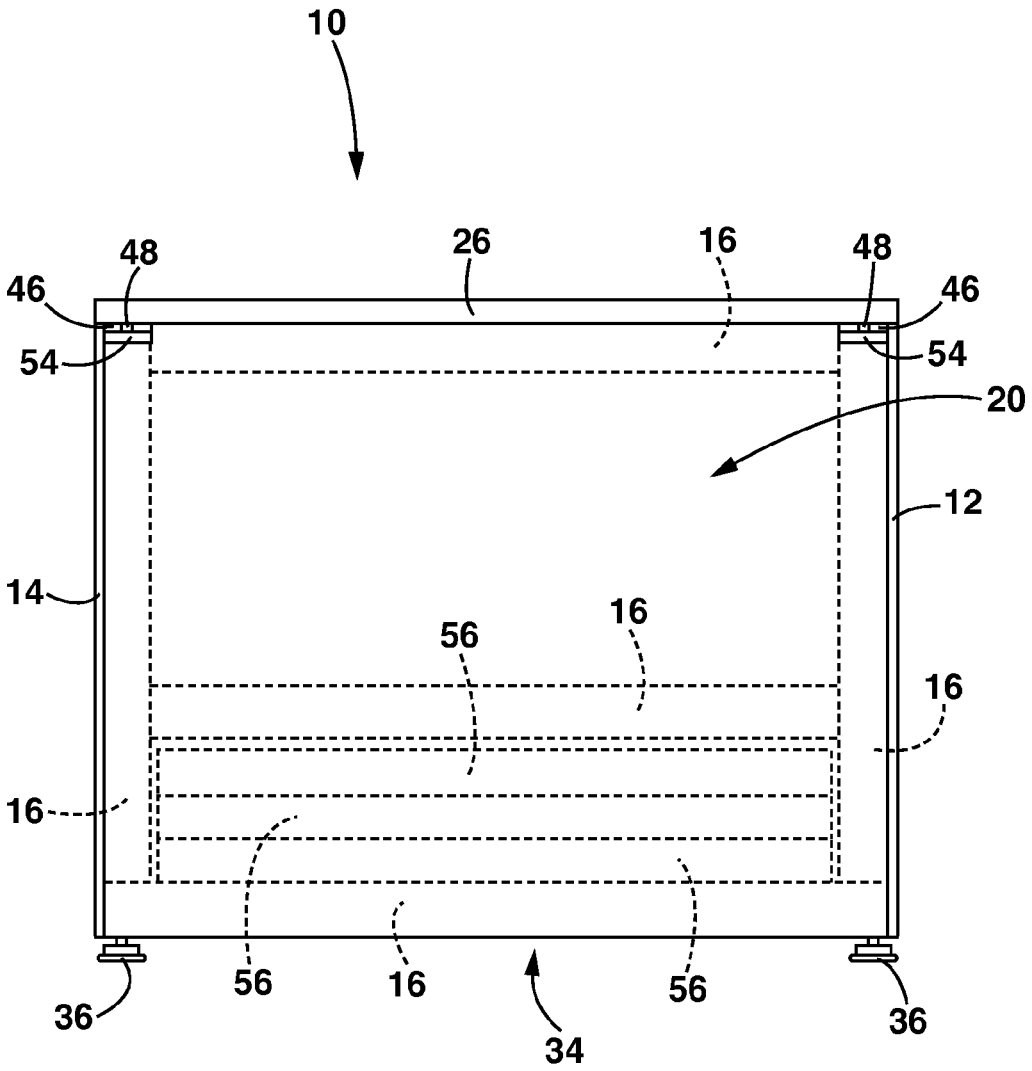
FIG. 8 is a back view of FIG. 2 with the back panel in place.

As shown in FIG. 8, a back view of FIG. 2 with the back panel 20 in place. Above the bottom 34 in the back portion of cabinet 10 are located one or more counter weights 56. In the preferred embodiment, the counter weights 56 are three in number and constructed of poly vinyl chloride tubing filed with concrete weighing two pounds each. The purpose of the counter weights 56 is to keep the cabinet 10 from tipping forward when the fully loaded drawer 38 is extended in an open position. The counter weight may further have enough weight to prevent tipping with a plurality of storage cabinets stored one over the other.

Figure 9:
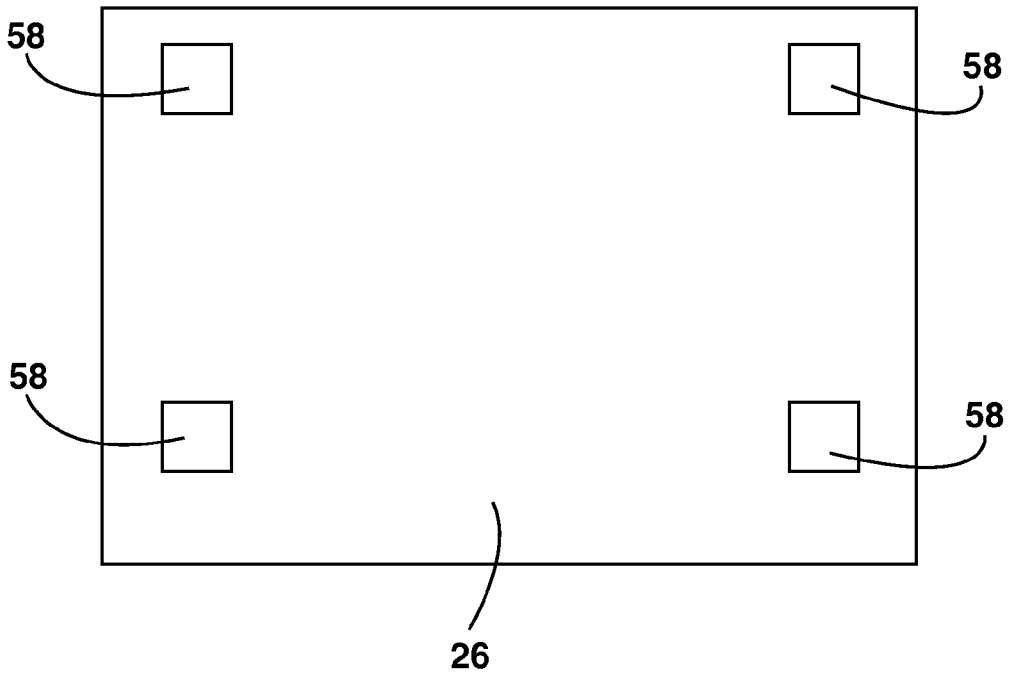
FIG. 9 is a bottom view of the top panel.

FIG. 9 illustrates a bottom view of the top panel 26. Four spacing blocks 58 constructed of 0.75 inch thick material are fastened to the bottom of top panel 26. The blocks 58 are placed in a fashion to hold top panel 26 in its place on cabinet 10.

Figure 10:
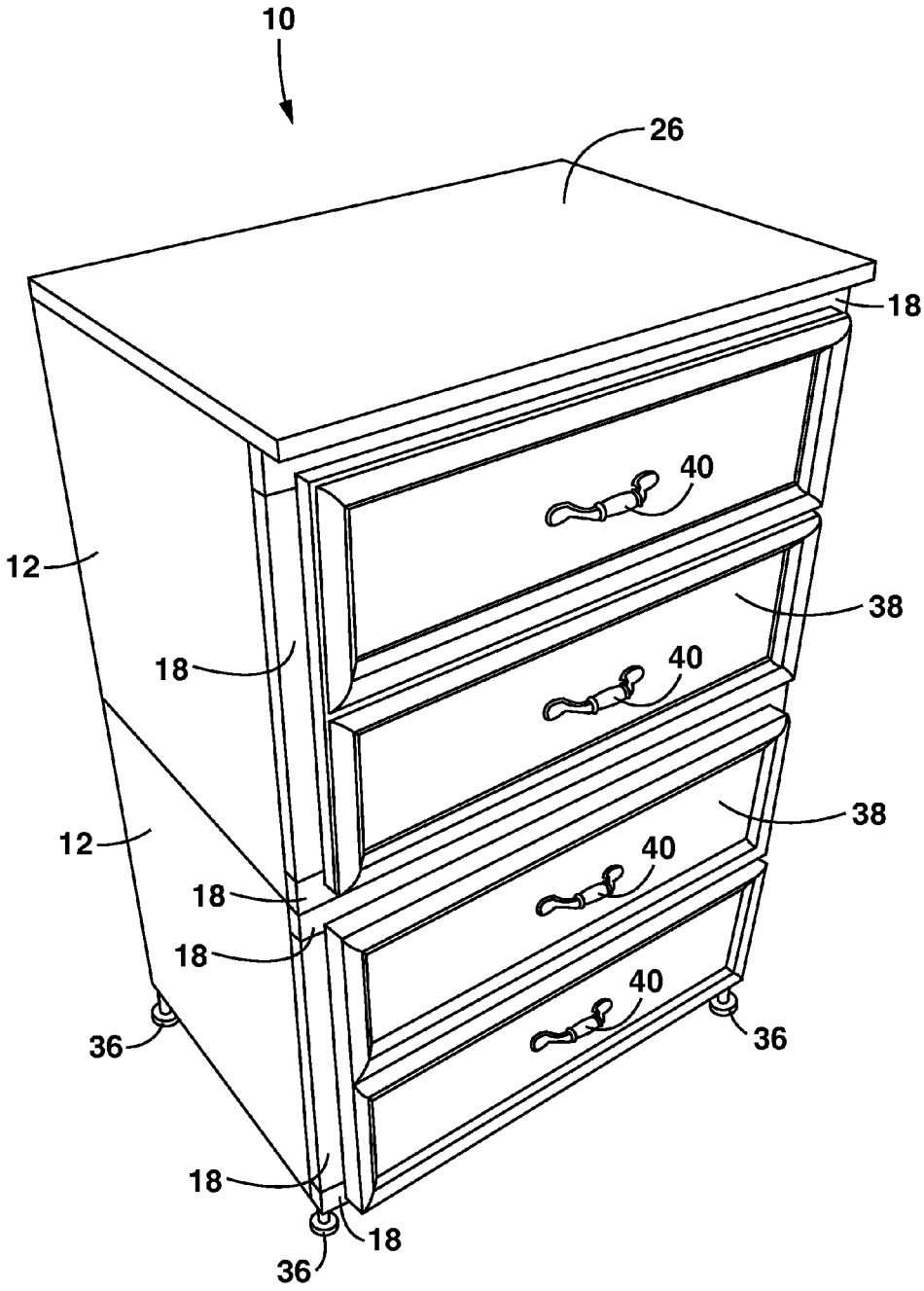
FIG. 10 is a perspective view with two stackable footwear storage cabinets interlocked together.

Referring to FIG. 10 through FIG. 15. One or more cabinets can be used in an assembled configuration and stacked two or three cabinets high, in the preferred embodiment, as shown in FIG. 10. To create such an assembly the top panel 26 is removed from a cabinet 10. Subsequent cabinets 10 are placed on top of one another in the following fashion.

Figure 13:
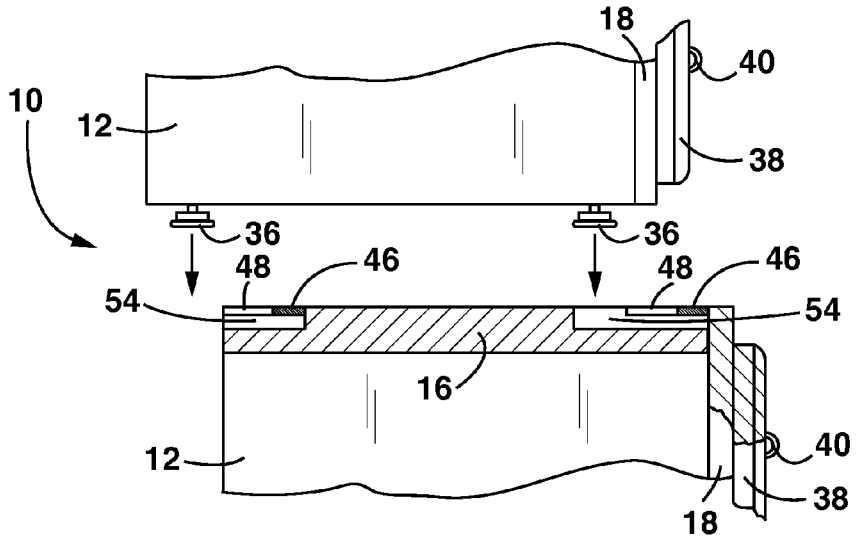
FIG. 13 is a sectional view detailing the interlocking feature.

FIG. 13 illustrates a sectional view detailing the interlocking feature. In this view a second cabinet 10 is lifted above a first cabinet 10 and positioned slightly off center toward the back of a first cabinet 10. The purpose illustrated is to align the front two feet 36 over the front two cavities 54 and set the cabinet into place with the front two feet 36 resting in the front two cavities 54. In this step the rear two feet are left outside of the first cabinet 10.

Figure 14:
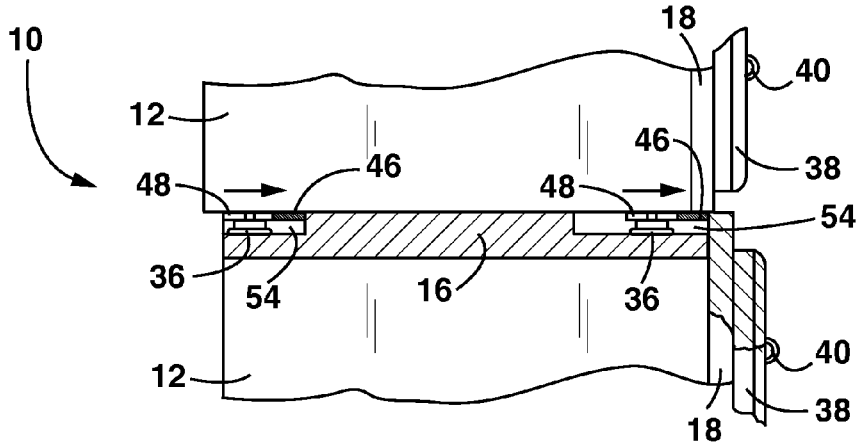
FIG. 14 is a detail like FIG. 13 with cabinets in position to interlock.

In FIG. 14, it is shown, the second cabinet 10 has been moved slightly forward with the feet 36 sliding slightly forward in cavities 54. The cabinets 10 are, both, now in position to interlock.

Figure 11:
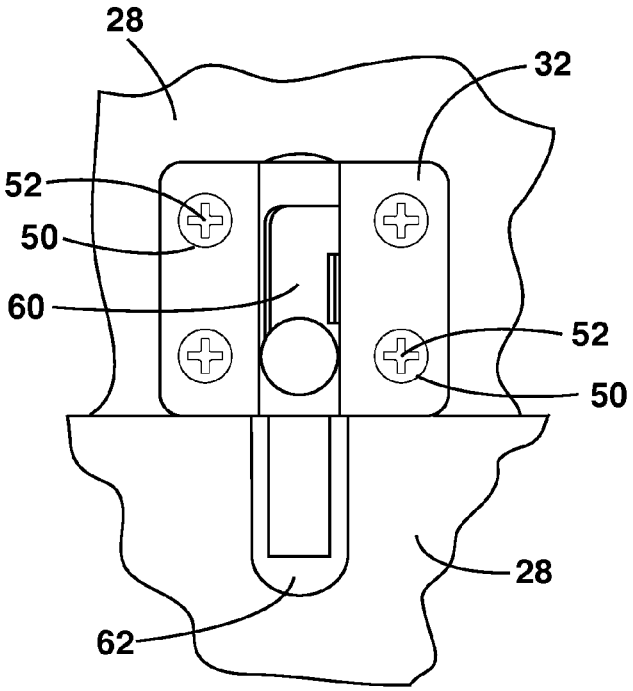
FIG. 11 is a front detail view of the latch.
Figure 12:
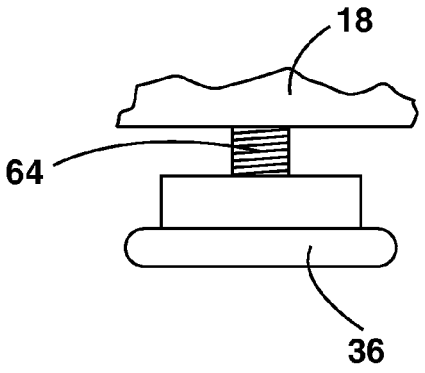
FIG. 12 is a front detail view of the foot.
Figure 15:
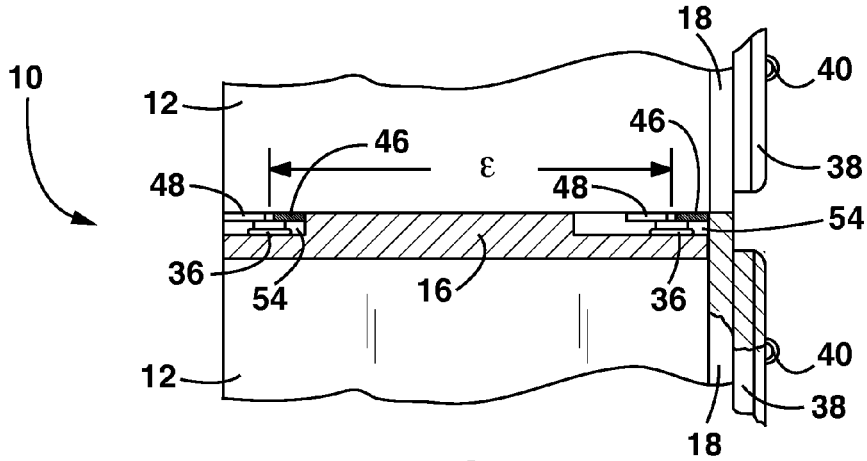
FIG. 15 is a detail view like FIG. 13 with cabinets interlocked.

FIG. 15 illustrates second cabinet 10 moved fully forward to completely interlock with first cabinet 10. At this time, the drawer 38 of second cabinet 10 is opened and the slide bolt 60, on latch 32, is engaged with notch 62. Thus, as shown in FIG. 11, securing cabinets 10 from movement relative to one another.

While the foregoing invention has been described in some detail for purposes of clarity and understanding, it will be appreciated by one skilled in the art, from a reading of the disclosure, that various changes in form and detail can be made without departing from the true scope of the invention.

What is claimed is:

1. A storage cabinet comprising:

left side, right side, and rear panels arranged to provide a structure with an interior space and an opening in a front of the structure for access to the interior space, and a left side member located at a top of the left side panel that extends between a front and back of the cabinet, and a right side member located at a top of the right side panel that extends between the front and back of the cabinet, each of the left and right side members having a plurality of cavities therein at opposing corners of the storage cabinet, each of the cavities having a slotted connecting plate partially enclosing the cavity, the connecting plate having a top and a bottom, the bottom of the connecting plate facing inward toward the cavity, the cavities having a depth between a bottom of the cavity and the bottom of the slotted connecting plate;

at least one drawer coupled to the structure with at least one slide, the at least one drawer therewith slidable between a closed position and an open position exposing contents of the drawer, the at least one drawer comprising dividers essentially orthogonal to a base of the drawer arranged to form a plurality of vertical compartments; and a plurality of feet located at opposing corners of the storage cabinet, each of the feet having a threaded portion adjustably coupled to the structure and a knobbed portion coupled to the threaded portion, the knobbed portion having a height essentially the depth of a corresponding cavity in one of the left and right side members, the cavities in the left and right side members revealed by removing a removable top, wherein the storage cabinet is connectable to another storage cabinet by inserting the knobbed feet of the another storage cabinet into partial openings in the cavities of the storage cabinet so that the feet of the another storage cabinet rest on the bottoms of the cavities and so that the weight of the another storage cabinet rests on the bottoms of the cavities, and sliding the another cabinet forward so that the knobbed feet interlock with the slotted connecting plates of the storage cabinet so as to prevent the another storage cabinet from lifting off of the storage cabinet without restricting rearward movement, the storage cabinet therewith stackable with the another storage cabinet.

2. The storage cabinet of claim 1, wherein the panels are arranged to form a cubic structure.

3. The storage cabinet of claim 1, comprising at least one counterweight located in the cabinet to prevent tipping of the storage cabinet when the at least one drawer is extended to the open position.

4. The storage cabinet of claim 1, wherein the another storage cabinet is identical to the storage cabinet.

5. The storage cabinet of claim 1, wherein the dividers form a grid of at least 2×2 vertical compartments.

6. The storage cabinet of claim 5, wherein each of the vertical compartments have a depth sufficient to accept a pair of shoes.

7. The storage cabinet of claim 1, wherein a latch is located at a top of the rear panel and engages with a bottom of a rear panel of the another storage cabinet.

* * * * *